US006109442A

United States Patent [19]

Roegner

[11] Patent Number: 6,109,442

[45] Date of Patent: Aug. 29, 2000

[54] NAIL CARE CASE

[76] Inventor: DeAnna Roegner, 774 Mays Blvd. #10-405, Incline Village, Nev. 89451

[21] Appl. No.: 09/234,808

[22] Filed: Jan. 21, 1999

[51] Int. Cl.[7] ..... B65D 69/00

[52] U.S. Cl. ..... 206/581; 206/823; 206/479; 150/106; 150/113

[58] Field of Search ..... 206/581, 823, 206/373, 478, 479, 483; 150/106, 113, 114, 117, 118, 130; 190/102, 110, 111, 127, 901, 903

[56] References Cited

U.S. PATENT DOCUMENTS

| | | | |
|---|---|---|---|
| 1,206,276 | 11/1916 | Wallach | 206/581 |
| 1,915,007 | 6/1933 | Weiss . | |
| 2,000,302 | 5/1935 | Solomon | 206/581 |
| 2,038,319 | 4/1936 | Stanley . | |
| 2,092,834 | 9/1937 | Doppelt . | |
| 2,167,926 | 8/1939 | Glasker . | |
| 2,299,673 | 10/1942 | Zolkind . | |
| 2,359,100 | 9/1944 | Florin . | |
| 2,413,465 | 12/1946 | Ohlsen . | |
| 2,554,215 | 5/1951 | Schell et al. . | |
| 2,623,566 | 12/1952 | Kibler | 150/113 |
| 2,764,201 | 9/1956 | Whippo | 190/110 |
| 4,386,642 | 6/1983 | Durbin . | |
| 4,723,657 | 2/1988 | Robinson | 190/109 |
| 5,052,555 | 10/1991 | Harmon . | |
| 5,054,589 | 10/1991 | Bomes et al. | 190/18 A |
| 5,829,502 | 11/1998 | Distefano et al. | 150/113 |
| 5,845,780 | 12/1998 | Allen | 206/579 |
| 5,909,811 | 6/1999 | Harris | 206/581 |
| 5,918,711 | 7/1999 | Godshaw | 190/107 |

*Primary Examiner*—Paul T. Sewell
*Assistant Examiner*—Nhan T. Lam
*Attorney, Agent, or Firm*—Baker & Maxham

[57] ABSTRACT

A nail care case for organizing and storing manicuring implements and articles is described designed to be carried by hand or stored in a purse. The case includes a foldable semi-rigid enclosure defining a receptacle in which preferably, at least two panels are attached. These panels are contained within a recessed folded sections of the enclosure. Features of each panel includes retaining flexible loops for mounting a plurality of manicuring implements and articles, a detachable hinged retainer member for stabilizing bottles and other containers when performing a manicure, a detachable holder in which other objects are stored, a mesh-type pocketed retainer with foldable flap using hook and loop fasteners. Attached to enclosure is a foldable workstation panel that can include storage pocket to hold objects. Moreover, an auxiliary pivotally mounted panel can be attached to the enclosure for mounting additional manicuring implements and articles.

15 Claims, 4 Drawing Sheets

NAIL CARE CASE

BACKGROUND OF THE INVENTION

The present invention relates to article carrying cases and pertains particularly to a case having improved arrangement of multiple pockets, mounting panels for holding multiple personal nail manicuring implements and a pliable workstation panel contained within a hand carried or purse-sized case.

Women generally have many implements and other items of makeup which they commonly carry in their purse. These cosmetic items usually include nail care products, among these items. Such items are often placed loosely in the purse among other articles. This often leaves the cosmetic items disorganized, which can accidentally open, or often become entangled with other objects in the purse causing consternation when not readily found. Moreover, during a manicure, hands are often placed on furniture or clothing that often become soiled by nail filings and/or nail polish. Additionally, bottles containing nail polish and polish remover often spill since they are placed in an unstable manner and not secured to a fixture when in use.

In view of these problems, there is a need for a nail care case that is adaptable to mount or hold many different nail manicuring articles and implements in an organized fashion and has a readily available workstation panel for hand placement during a manicure. Moreover, It would be desirable to have a nail care case that has several mounting panels with pockets, a retainer member for containers, and a workstation panel that: a) holds many nail manicuring implements and articles for ease of use; b) minimizes nail polish bottle spills when in use; and c) protects furniture and clothing when in use.

SUMMARY OF THE INVENTION

It is the primary object of the present invention to provide an improved nail care case intended for a hand carrying or storage in a purse, the case having multiple pockets, a foldable workstation panel and attachment members for holding manicuring articles and implements of different sizes that are securable and readily accessible in an organized arrangement for use during a manicure.

An exemplary nail care case for manicuring implements and articles to be carried by hand or in a purse comprises a folding semi-rigid case defining an enclosure in which preferably, at least two panels are attached. These panels are contained within recessed folded sections of the enclosure. Features of each panel include retaining flexible loops for mounting a plurality of manicuring implements and articles, a detachable hinged retainer member for stabilizing bottles and other containers during a manicure, a detachable holder in which other objects are stored, a mesh-type pocketed retainer with foldable flap using hook and loop fasteners. Attached to the enclosure is a foldable workstation panel that can include storage pockets. Moreover, an auxiliary pivotally mounted panel can be attached to the enclosure for mounting additional manicuring implements and articles.

BRIEF DESCRIPTION OF THE DRAWING

The above and other objects and advantages of the present invention will become apparent from the following description when read in conjunction with the accompanying drawing wherein.

DETAILED DESCRIPTION OF THE PREFERRED EMBODIMENTS

Figure 1:
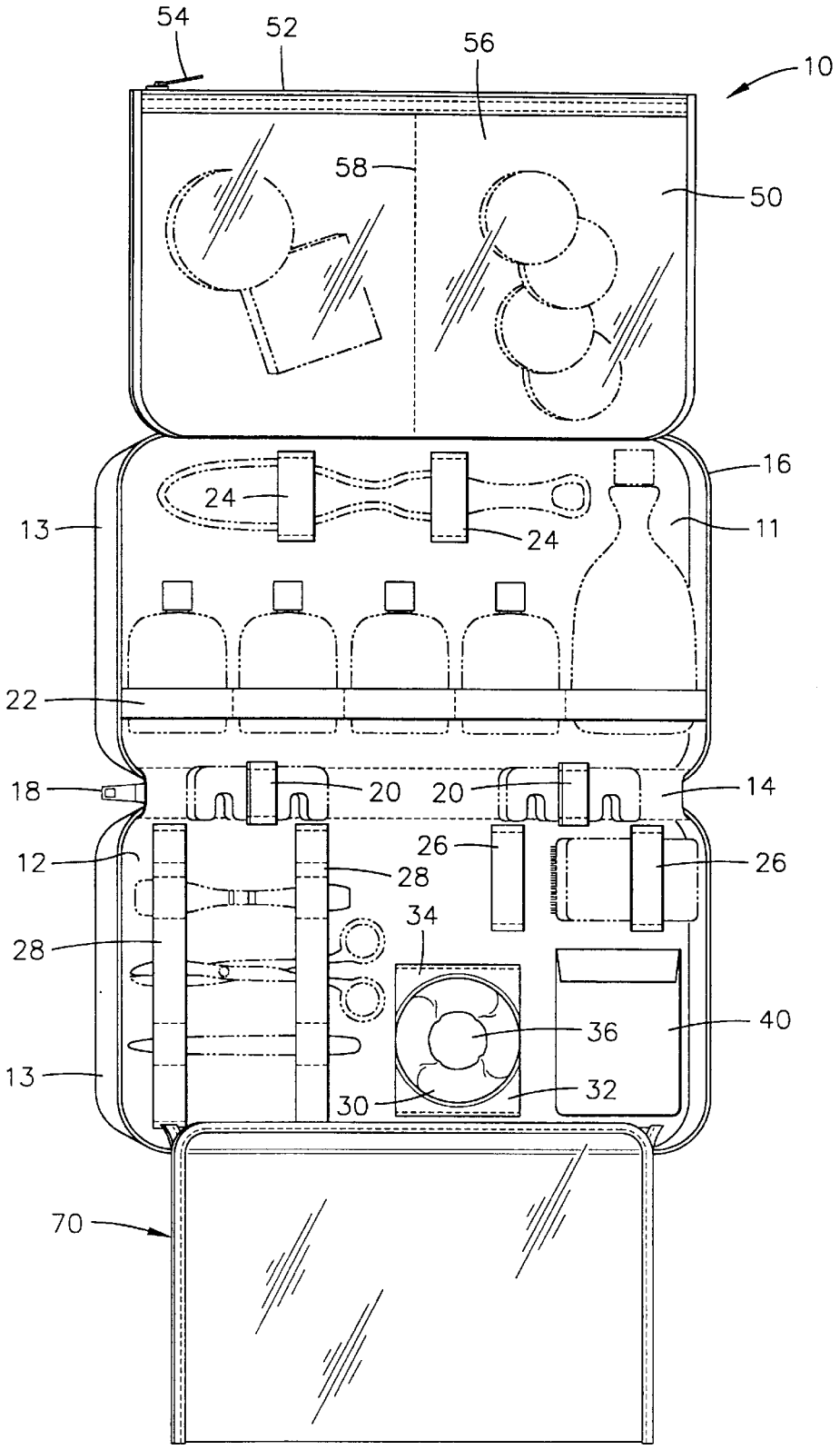
FIG. 1 is a front elevation view of one exemplary preferred embodiment of the invention of a hand carried case in perspective view.

Referring to FIGS. 1 through 5 of the drawing, an exemplary hand carried nail care case in accordance with the invention is illustrated and designated generally by the numeral 10. In FIG. 1, the case is open and in FIG. 5, the case is closed. An outer shell 13 of the case is preferably constructed of a pliable material, such as leather, vinyl, or any of the suitable woven materials, now widely used for handbags, purses, suit cases and the like. The outer shell 13 has optionally a stiffener such as a cardboard or the like sandwiched between opposing faces of a multilayered pliable fabric panel to maintain the shape of the case. Alternatively, depending on the size of case, the seam construction of the outer edges of the case enclosure can also provide the desired stiffening of the case enclosure without need for a stiffener attached to the outer shell 13 facing.

The case preferably includes two internal panels 11 and 12 substantially of a unitary elongated rectangular form having outer faces that attach to the internal side of the shell 13. These panels can also be made to be detachable from the case enclosure using hook and loop fastener tabs that cooperatively attach the inner side of the case enclosure with the cooperatively mating panel to allow interchangeableness of panels that have alternate type of manicure implements and articles.

The case enclosure is foldable along a transverse line 14 for closure of the case. The case 10 also has an opening and closing fastener member such as a zipper 16 with cooperative slider 18 that surrounds the case perimeter, or alternatively, a hook and loop structure that cooperatively connect along mutual corresponding sides of the case. The term "fastener" can encompass equivalent members for securing a member that include zippers, snap buttons, closing hook and loop and other well known fastener articles. The shape of the case 10 is preferably rectangular in shape, but can be of other shapes such as circular, semicircular or polygonal.

The two primary panels 11 and 12 as shown in the illustrated embodiment comprise two elongated, generally rectangular panels having multiple forming loops, illustrated as 20, 22, 24, 26 and 28 and have various locations attached to the panels for securing manicuring implements and articles such as finger holders, nail buffers, bottles of nail polish and polish remover, tweezers, nail files, orange sticks, emory boards, toe clips, nail clips cuticles, and so on. These multiple loops have limited elasticity to allow ease of mounting and holding these manicuring implements. These multiple loops 20, 22, 24, 26 and 28 are selectively secured at particular panel locations so as to form fit certain manicuring items such as nail cutting scissors and oblong shaped files. For example, the strap or loop 20 are positioned between the two panels 11 and 12 and are shown holding finger holders. The strap 22 forms a series of loops along one side of panel 11 for holding containers or bottles of polish and polish remover. Straps 24 form aligned loops or panel 11 and hold a large implement such as a file. Straps 26 form loops holding a brush and another article. The straps 28 form a series of vertically spaced horizontally aligned loops that hold a variety of tools such as files, scissors, clippers and the like.

Attached to the enclosure is a pliable and foldable workstation panel 70 having a work area devoid of pockets and other obstructions about as large as a primary panel. The workstation panel 70 is preferably made of a clear plastic material that folds out of the case enclosure for placement on a surface such as a tabletop or a person's lap. The workstation panel functions as a portable mat that prevents soiling of furniture or clothing by nail polish or nail filings. Since the workstation panel is attached to case enclosure, a user always has it readily available for use without concern of not being in the case.

Figure 2:
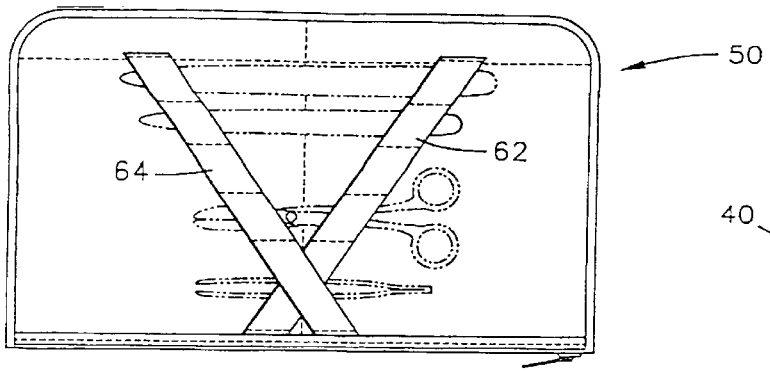
FIG. 2 is a back side of an auxiliary storage panel shown in FIG. 1.

Referring to FIGS. 1 and 2, attached to the panel 11 is a foldable auxiliary panel 50. The auxiliary panel has a pocket assembly 56 that is of an envelope-type construction with a front panel secured along side and bottom edges to form a pocket with an opening at the top. The opening is provided with a suitable closure such as a zipper 52 with slider 54 at the upper edge over the opening to close the pocket assembly. The pocket may be made out of any suitable fabric or other suitable pliable material, preferably clear plastic. The pocket assembly 56 can include a partitioning stitch 58 for providing multiple organizing pockets for storing assundry items (for example, nail polishing pads and finger sand paper).

In FIG. 2, the attachment members in the illustrated embodiment are constructed of at least a pair of elastic straps attached to one of the faces of the auxiliary panel 50, thereby forming loops. As shown, two multiple loop straps 62 and 64 form what can be termed a loop for attaching at least one implement. These loop straps 62 and 64 are preferably sewn to the back side of panel 50 for proper storage in the case. These loop straps multiple and varied sized implements such as files, cuticles, tweezers or finger clippers.

Figure 3:
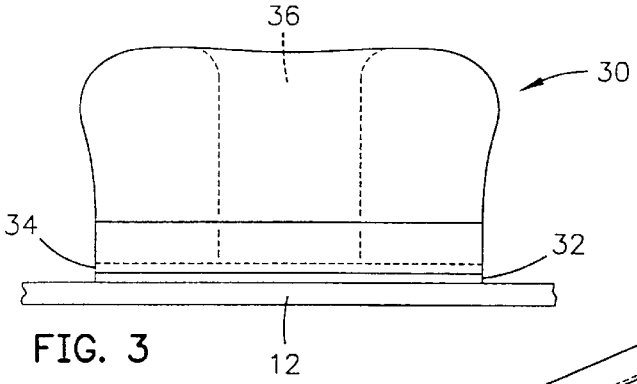
FIG. 3 is a side view of a hinged pliable retainer for stabilizing and holding bottles and containers when performing a manicure with the case open.
Figure 5:
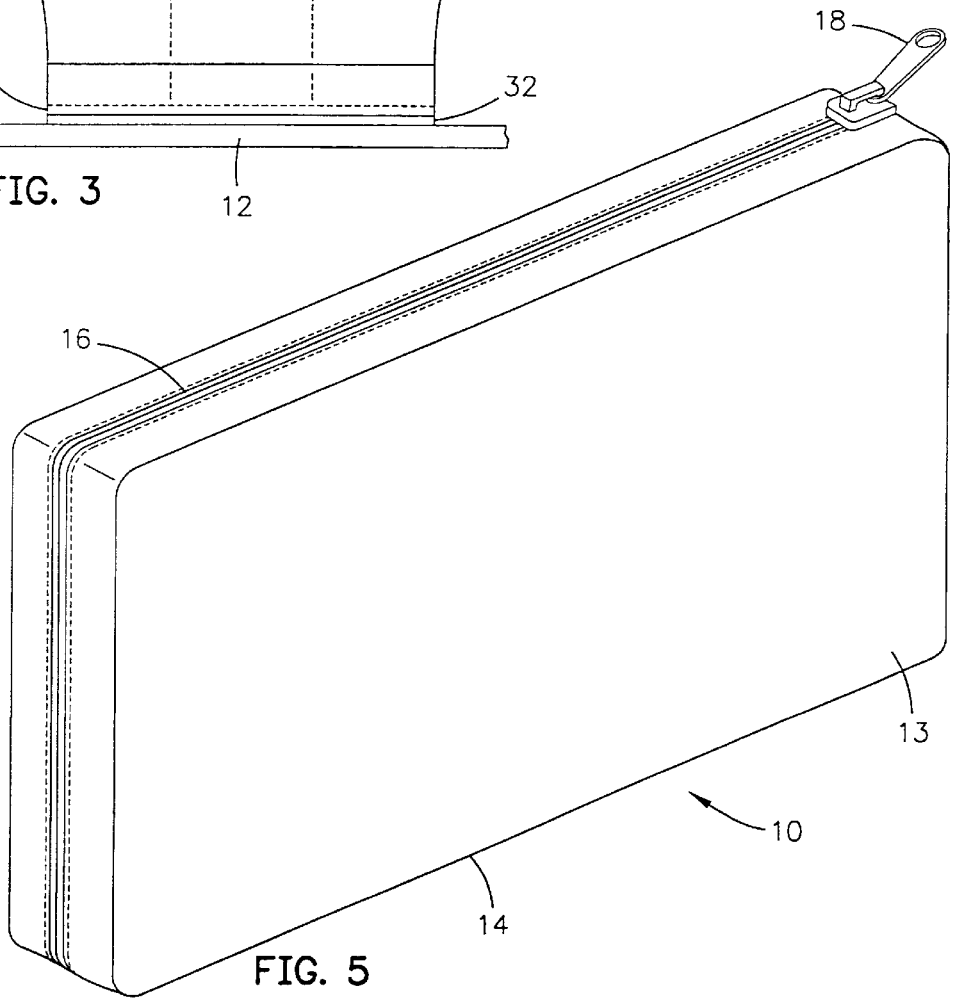
FIG. 5 is a view of the case shown in FIG. 1 when closed.

Referring to FIGS. 1 and 3, a fabric donut shaped retainer member 30 is attached to panel 12 by a sewn hinge section 34 and a hook and loop fastener 32. Such a design allows partial detachment and swinging of the retainer member so as to allow insertion and positioning of a nail product container such as nail polish bottle. This ensures stable positioning and holding of the container during manicure use. The retainer 30 is made of a flexible stretchable outer material with inner foam lining that compliantly holds a container in place, yet allows ease of removal from the retainer 30. When used, a nail polish bottle can be held within the retainer 30 by unfastening the hook and loop fastener 32 and swinging back such that the nail polish bottle can be inserted in the void 36. Then, the retainer 30 is refastened by the hook and loop fastener 32 to the panel 12.

Figure 4:
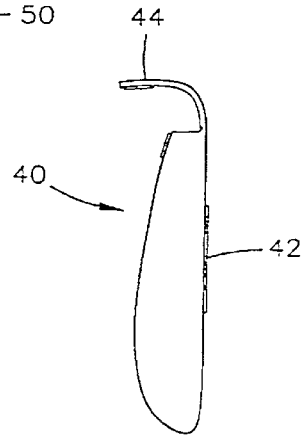
FIG. 4 is a side view of a detachable holder shown in FIG. 1.

Referring to FIGS. 1 and 4, the panel 12 can receive and detachably attach a pliable holder 40 that has a foldable cover 44 with fastener member for closure of the holder. The holder can be made of fabric or a plastic material. A hook and loop fastener 42 is attached between the back of the holder 40 and the panel 12, which allows detachment from the panel 12 as shown. This holder 40 is suitable for storing cards, cigarettes and the like.

Figure 6:
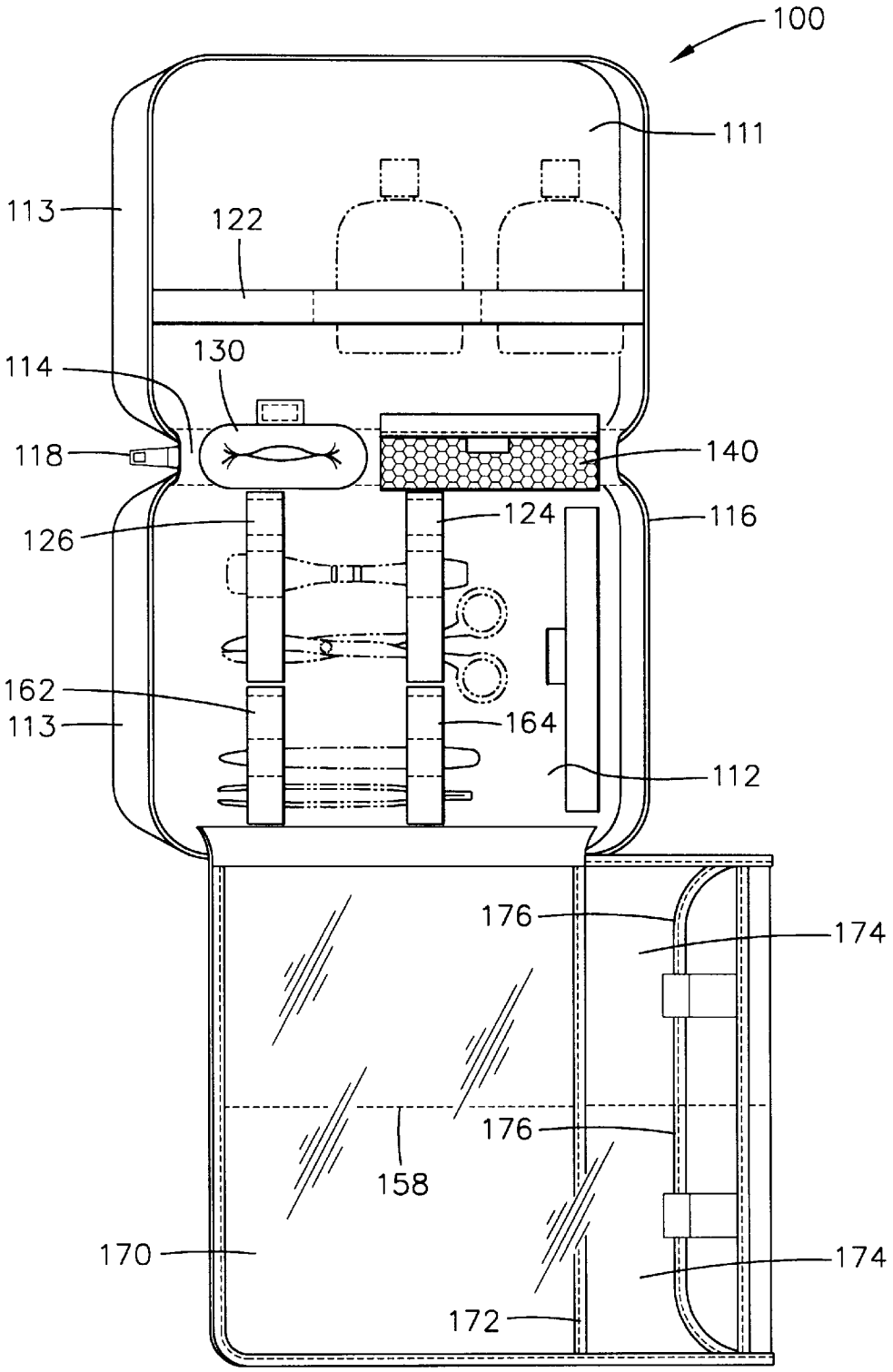
FIG. 6 is a perspective view of another exemplary embodiment of the invention of a purse-sized nail care case.
Figure 7:
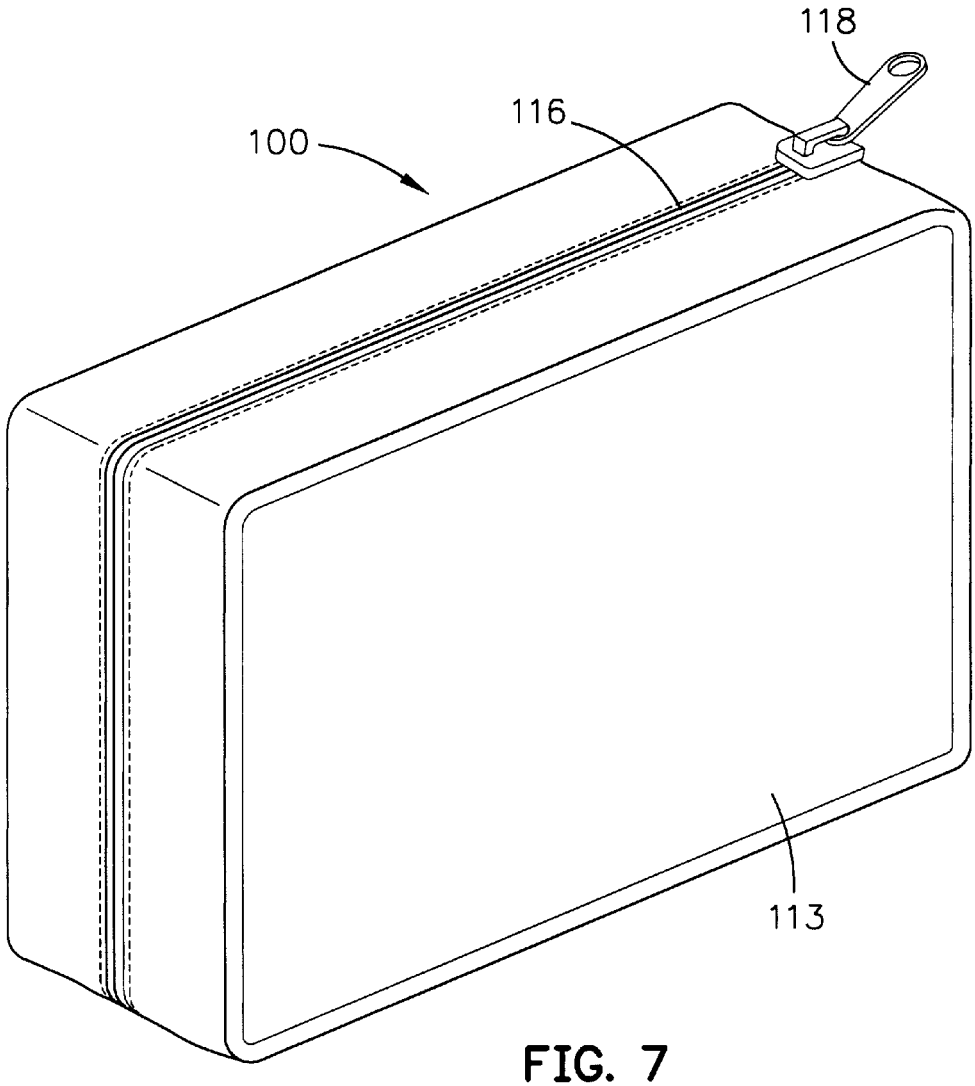
FIG. 7 is a view of the case shown in FIG. 6 when closed.

Referring to FIGS. 6 and 7 of the drawing, another exemplary embodiment of a nail care case in accordance with the invention is illustrated and designated generally by the numeral 100. This form of the case is for purse-sized use. In FIG. 6, the case 100 is open and in FIG. 7, the case is closed. As discussed above, this embodiment of the invention has similar features that include an outer shell 113 preferably constructed of a pliable material, such as leather, vinyl, or any of the suitable woven materials, now widely used for handbags, purses, suit cases and the like. This embodiment also can include a stiffener such as a cardboard or the like sandwiched between opposing faces within the outer shell 113 to provide case enclosure stiffening.

This embodiment is also preferably provided with panels 111 and 112 of substantially unitary elongated rectangular form having outer faces that preferably attach to an internal side of the shell 113 forming the case enclosure. These panels can be detached from the case enclosure by hook and loop fastener tabs that cooperatively attach the inner side of the case shell with the back side of the panels to allow interchangeableness of panels having varying type of implements. The case is foldable along a transverse line 114 for case closure. The case 100 has an opening and closing fastener member such as a zipper 116 having a slider 118 that surrounds the case perimeter, or alternatively, a hook and loop structure.

The two panels 111 and 112 as shown in the illustrated embodiment comprise two elongated generally rectangular panels have multiple loops, illustrated as 120, 122, 124, 126, and many others at various locations attached to the primary panels for securing manicuring implements such as finger holders, bottles of nail polish, tweezers, nail files, toe clips, nail clips and so as shown. These multiple loops have limited elasticity to allow ease of securing to or obtaining from the case any of these manicuring implements. These multiple loops are selectively secured at panel locations so as to form fit particular manicuring implement.

Also attached to the panel 112 are two multiple loop straps 162 and 164, each forming what can be termed a plurality of loops for the attachment of at least one article such as files, cuticles, tweezers and finger clippers. These multiple loop straps 162 and 164 are sewn to the panel 112 so as to form fit at least one sized elongated manicuring implement for proper storage in the case. These straps or loops can hold any number and size of implements such as small files, nail clippers, and other similar implements. This embodiment of the invention can also include a donut retainer 130 having a sewn hinge and a hook and loop fastener, as discussed above, that attaches at a center fold section of the case enclosure.

This embodiment of the invention can also include at least one mesh-type pocket assembly 140 inside the case enclosure preferably made of a web, netting or mesh-type material with a securable foldable flap using preferably a hook and loop fastener. Other fasteners can be snaps, zipper and sliders and other well know equivalents in the fastener arts. As shown, this pocket assembly 140 provides ease of identifying articles contained within and lets air surround these articles to allow drying if a concern. This embodiment of the invention may have any number of the pocket assemblies suitable for holding any number and kind of small articles.

Attached to the panel 112 is another version of a pliable and foldable workstation panel 170 with similar features as discussed above. The workstation panel 170 can include a pocket assembly 174 attached at edge 172 leaving a work area devoid of pockets and other obstructions about as large as a primary panel. The pocket assembly 174 is formed of an envelope-type structure with a front panel secured along side and bottom edge of the workstation panel 170 to form at least one pocket with an opening at the top (two pockets are shown). The opening is provided with a suitable closure cover 176 over the opening to close the pocket. The pocket assembly is preferably made integral with the workstation panel 170 and may be made out of any suitable fabric or other suitable pliable material, preferably clear plastic. The pocket assembly can include a partitioning stitch 158 for organizing contents within multiple pockets (for example, nail polishing pads and finger sand paper) to allow ease of constructing the pocket assembly and the workstation panel 170.

While I have illustrated and described my invention by means of specific embodiments, it is to be understood that numerous changes and modifications may be made therein without departing from the spirit and the scope of the invention as shown in the appended claims. Such changes include repositioning and the number of mounting loops and pocket assemblies for a desired design and shape of the nail care case.

I claim:

1. A nail care case comprising:

a foldable enclosure defining a receptacle wherein at least one primary panel is mounted thereto, the at least one primary panel having a plurality of straps and loops for mounting a plurality of manicure implements and articles;

a deployable workstation panel having an unobstructed work area about as large as a primary panel secured to the nail care case and configured so that when deployed the workstation panel defines a substantially flat working surface for protectively covering a support surface; and a flexible donut shaped retainer member coupled to the foldable enclosure, the flexible donut shaped retainer member configured to securely grip a container when the enclosure is open.

2. The nail care case of claim 1 further comprising:

a pocket assembly coupled to the foldable enclosure, the pocket assembly configured to form a storage space.

3. The nail care case of claim 2 wherein the pocket assembly is pivotally mounted on a front side of an auxiliary panel that attaches to an edge of the enclosure.

4. The nail care case of claim 1 wherein another side of the auxiliary panel includes a plurality of attachment members comprising at least a pair of elastic straps that attach to the auxiliary panel, each strap forming a plurality of loops for securing the manicuring implements and articles.

5. The nail care case of claim 2 wherein the pocket assembly is pivotally mounted and attaches to an edge of the workstation panel.

6. The nail care case of claim 1 wherein the case enclosure has a fastener that substantially surrounds a perimeter of the enclosure for closing the case.

7. The nail care case of claim 1 wherein the at least one primary panel includes a plurality of attachment members comprising at least a pair of elastic straps that attach to the at least one primary panel, each strap forming a plurality of loops for securing the manicuring implements and articles.

8. The nail care case of claim 1 wherein the hinged flexible retainer member attaches to the at least one primary panel.

9. The nail care case of claim 1 wherein the hinged flexible retainer member attaches to the enclosure at a foldable mid-section of the enclosure.

10. The nail care case of claim 1 further having a detachable holder for storing objects, the detachable holder configurably attaches to the at least one primary panel by a fastener.

11. The nail care case of claim 1 comprises a purse-sized case.

12. The nail care case of claim 1 comprises a hand-carrying case.

13. A nail care case, the case comprising:

a foldable enclosure defining a receptacle wherein at least one primary panel is mounted thereto, the at least one primary panel having a plurality of straps and loops for mounting a plurality of manicure implements and articles; and a flexible donut shaped retainer member coupled to the foldable enclosure, the flexible donut shaped retainer member configured to securely grip a container when the enclosure is open.

14. The nail care case of claim 13 further having a foldable workstation panel panel having an unobstructed work area about as large as the area of the primary panel that attaches to the nail care case.

15. A purse-sized nail care case comprising:

a foldable enclosure defining a receptacle wherein at least one primary panel is mounted thereto, the at least one primary panel having a plurality of straps and loops for mounting a plurality of manicuring implements and articles;

a deployable workstation panel having an unobstructed work area about as large as the area of the primary panel that attaches to the nail care case and configured so that when deployed the workstation panel defines a substantially flat working surface;

a pocket assembly coupled to an edge of the workstation panel, the pocket assembly configured to form at least one storage space; and a flexible donut shaped retainer member coupled to the foldable enclosure, the flexible donut shaped retainer member configured to securely grip a container when the enclosure is open.

* * * * *